350-320 SR
3/11/86 XR 4,574,457

United States Patent [19]
Farnum, III

[11] Patent Number: 4,574,457
[45] Date of Patent: Mar. 11, 1986

[54] METHOD FOR FORMING A PRECISION SURFACE OF LARGE AREA

[75] Inventor: Francis H. Farnum, III, Portland, Me.

[73] Assignee: Gabriel Electronics Incorporated, Scarborough, Me.

[21] Appl. No.: 634,448

[22] Filed: Jul. 25, 1984

[51] Int. Cl.[4] ..... B21D 35/00
[52] U.S. Cl. ..... 29/469.5; 29/559; 156/285; 156/305; 156/382; 269/21; 343/761; 350/320
[58] Field of Search ..... 29/448, 428, 469.5, 29/559; 343/761; 126/438; 76/107 R; 156/285, 382, 305; 350/320; 269/21

[56] References Cited

U.S. PATENT DOCUMENTS 3,293,739 12/1966 Hoglund et al. ..... 269/21 X
3,322,190 5/1967 Johnson, Jr. ..... 29/448 X
3,434,181 3/1969 Benzies ..... 156/285 X
3,490,405 1/1970 Reader et al. ..... 29/428 X
3,550,142 12/1970 Dawson ..... 343/761 X
3,655,472 4/1972 Chandler ..... 156/285 X
4,115,177 9/1978 Nelson ..... 350/320 X
4,213,698 7/1980 Firtion ..... 29/559 X
4,268,332 5/1981 Winders ..... 126/438 X
4,372,027 2/1983 Hutchison ..... 126/438 X
4,468,848 9/1984 Anderson et al. ..... 29/559 X

*Primary Examiner*—Charlie T. Moon
*Attorney, Agent, or Firm*—Charles E. Pfund

[57] ABSTRACT

A thin sheet is formed into a surface having compound curvature by vacuum forming the sheet against an array of support posts which have been adjusted to define the locus of the desired surface. A rigid frame is placed on the exposed back surface of the sheet and bonded thereto while the vacuum formed shape is maintained. Alternatively, a frame of beam members kerfed to make them compliant is placed on the back surface and bonded to the sheet which restores the structural integrity of the beams by briding the kerfs.

7 Claims, 4 Drawing Figures

METHOD FOR FORMING A PRECISION SURFACE OF LARGE AREA

BACKGROUND OF THE INVENTION

The formation of metal members by stretch forming to the yield point over a conforming mold is well known. Such techniques involve a certain amount of spring back which is difficult to account for in the design of the mold over which the member is stretched.

In the manufacture of a precision surface such as the parabolic shape usually required for the reflector used in microwave antennas, the accuracy with which a sheet of reflective material such as aluminum can be maintained relative to a precise mathematical paraboloid surface is a factor which affects the overall performance of an antenna in which the reflector is used. Such reflectors are now commonly used in microwave antennas known as horn reflector antennas which have apertures of 6 feet in diameter or larger. Since the reflector sheet is generally positioned at approximately 45° to the axis of the antenna aperture, the area of the actual reflector is much larger than the horn antenna aperture.

In horn reflector antennas, the actual portion of the paraboloid surface which is used as a reflector depends on design parameters which dictate which portion of the total paraboloid is required to be produced as a reflector with an effective area for each particular antenna design. Once such a design is fixed, the mathematical definition and location of the paraboloid surface are readily ascertained but the formation of an aluminum sheet to assume and maintain that mathematically precise locus is only accomplished with difficulty. Typical manufacturing errors for a 10 foot aperture horn reflector antenna are approximately 0.020 inches rms.

SUMMARY OF THE INVENTION

Various factors influence the overall performance of horn reflector antennas but it has been found the operating characteristics can be improved by maintaining the paraboloidal surface area as close as possible to the precise mathematical paraboloid shape. In the present it has been found that improved accuracy can be obtained by manufacturing the compound curvature surface such as a paraboloid by means of an array of posts which can be individually precision adjusted to define the locus of the contour desired and drawing the sheet to be formed down by vacuum on the array of posts so that the tops of the posts support the reflector surface at the desired precise locations over its area. This shape is held by a rigid framework that is fastened to the back surface of the sheet as by epoxy bonding with the framework and sheet assembly being rigid enough to maintain the shape of the sheet when the vacuum holding pressure is relesed and later subjected to the rigors of commercial use.

Accordingly, it is the principle object of the present invention to provide a method for precision forming a compound curvature large sheet and maintaining the precision surface as a manufactued unit.

A further object of the invention is to provide a method for manufacturing precision microwave reflectors consistently within the improved tolerances using stretch-formed metal skin which is held in place to an accurate shape during manufacture and maintained in the desired shape by a back-up framework intimately bonded across the back surface of the reflector to provide a rigid assembly.

These and other objects of the invention will be apparent from the following detailed description taken in conjunction with the drawings.

DETAILED DESCRIPTION

Figure 1:
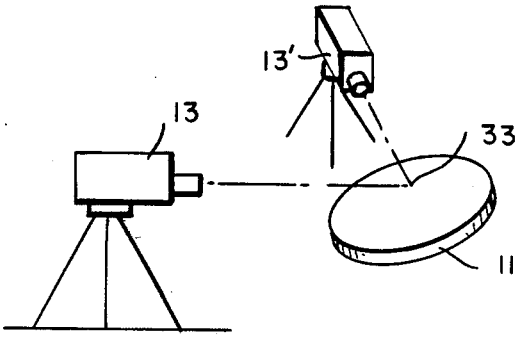
FIG. 1 is a diagrammatic view representing a procedure for accurately locating a point in three dimensional space.

Referring to FIG. 1, a schematic representation for locating a point in space is depicted. As will be described with reference to FIG. 2, a work fixture 11 has elements thereon which are required to be adjusted to accurately locate a plurality of points 33 with great precision in accordance with a predetermined map or calculation. For this purpose a unit known as the Hewlett-Packard theodolite coordinate determination system indicated at 13 can be utilized.

This measurement system requires aiming two electronic theodolites 13, 13' at each point 33. The system computer (not shown) then reads the azimuth and elevation angles from each theodolite. Using the method of triangulation the computer calculates and transforms the data into the desired coordinate system describing the position of the point in three dimensional space relative to a previously established reference.

Figure 2:
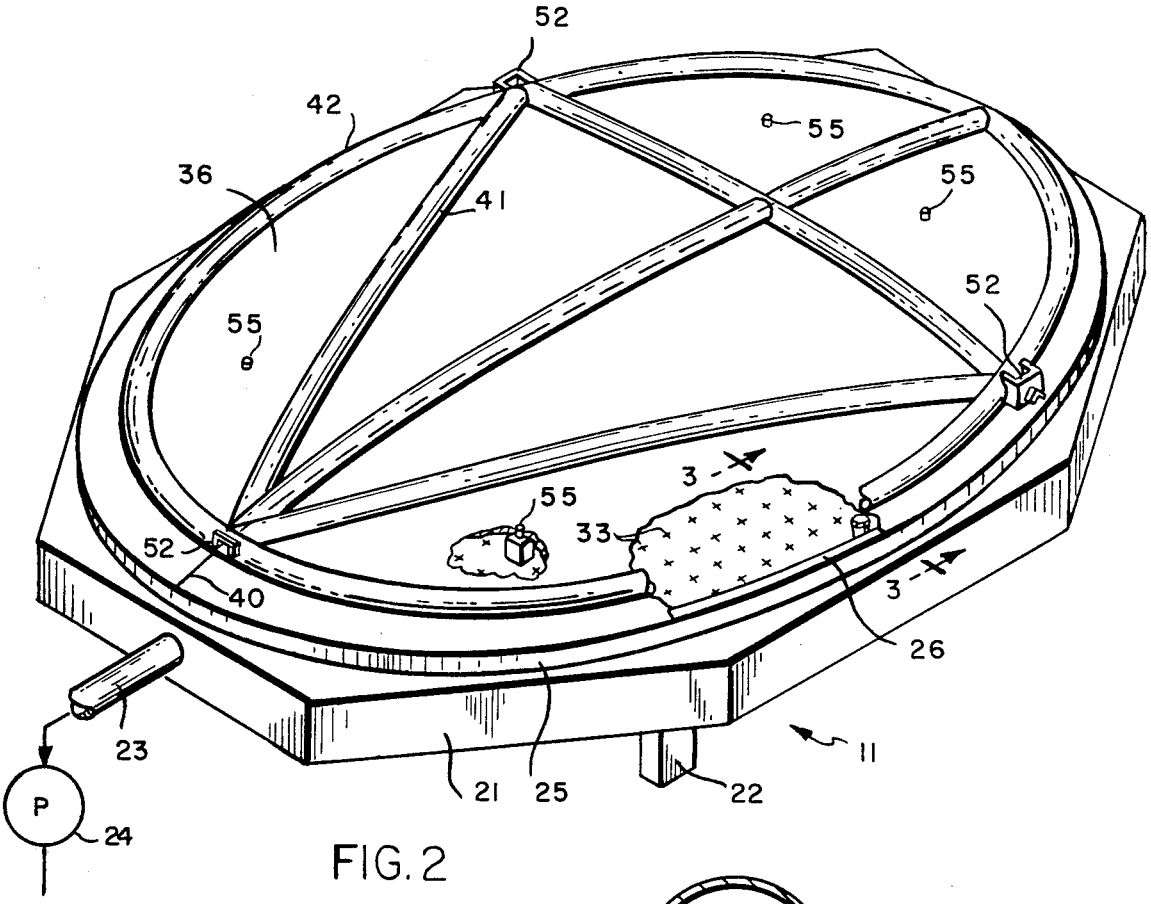
FIG. 2 is a perspective view of a fixture for forming a compound curvature surface and a back-up framework for assembly thereon to maintain that surface.

Referring now to FIG. 2, a detailed description of the work station 11 will be given. A strong base support 21 has legs 22 to provide a dimensionally stable work platform at a suitable height for convenient operations. The base 21 is constructed as a vacuum box with a suitable exhaust port 23 connected to vacuum pump 24.

Figure 3:
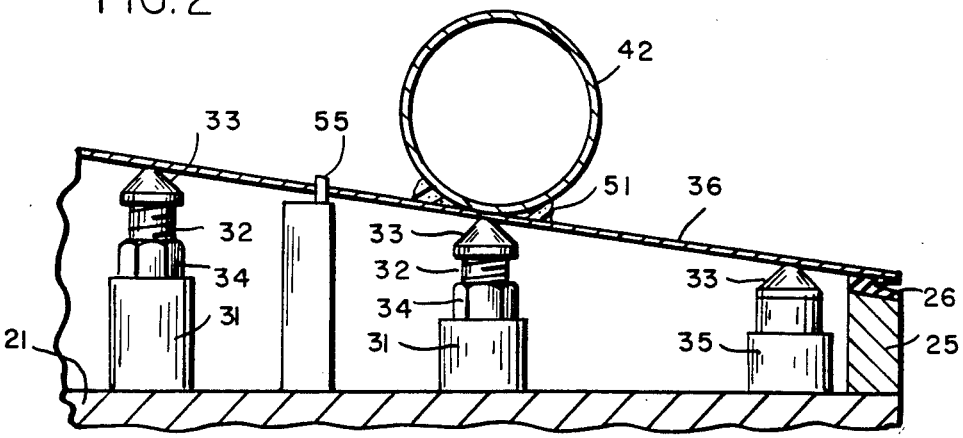
FIG. 3 is a detailed view taken along the lines 3—3 of FIG. 2.

On top of the vacuum box support a sidewall 25 extends around the peripheral boundary of the sheet to be formed on the fixture. The wall 25 has a flat top surface seal 26 on its top edge. Internal details of the fixture 11 are shown in FIG. 3. The base 21 supports an array of adjustable posts 31 which are uniformly spaced over the area of the sheet to be positioned thereon. The posts 31 may have a threaded rod or screw 32 which has a top cap 33 of hardened steel with rounded point, and a lock nut 34 for securing the screw 32 to establish an adjusted height for the rounded point of the top cap 33. The peripheral posts 35 are only slightly higher than the sidewall 25, such that when a workpiece 36 is drawn down in contact with the top cap 33 of posts 35 it engages the edge seal 26 to form an airtight contact between the workpiece 36 and the sidewall 25.

Referring now to FIGS. 1, 2 and 3, the method of the invention is practiced by first using the theodolites 13 to accurately position each of the top caps 33 in the array of posts 31 to a precision height which defines the locus of the surface area to which the workpiece is to be conformed. Since the workpiece contacts the rounded caps 33 at different angles over the area of the piece, this factor is to be taken into account during the adjustment of the height of each post, so that the point of contact on the grounded top cap 33 is the portion which is adjusted to the precision height required for accurately defining the locus of the curved surface. Once all of the posts 31 have been adjusted to have their top caps 33 precisely located the workpiece 36 is in the form of a thin metal sheet (or segments thereof with edges butt-joined to form a smooth surface) is placed on the fixture and located longitudinally and transversely with suitable indexing elements. For example, each segment of the workpiece 36 may have two holes drilled (or other means of marking by precision fixturing) during the stretch forming process. In the case shown in FIG. 2, the workpiece 36 consists of two segments with a longitudinal butt joint 40 which can be sealed with tape while the vacuum is applied. The holes in each segment line up with locator pins 55 accurately located on and affixed to the base 21.

With the sheet 36 in place, its edges are brought into contact with the edge seal 26 and vacuum (negative gage pressure) is applied by the pump 24 to partially evacuate the enclosure which is completed by the worksheet in contact with the edge seal 26. The force of the evacuated interior draws the sheet 36 down to rest uniformly in contact with each of the top caps 33 of the array of posts extending with incremental spacing over the entire area of the sheet 36.

With the sheet 36 thus held in its desired contour shape, a preformed rigid framework 41 is laid upon the back exposed surface of sheet 36. Alternatively, (or in combination) an array of kerfed beam members such as disclosed in Dawson U.S. Pat. No. 3,550,142 may be used. The framework 41 includes a peripheral member 42 which is generally elliptical in shape for the piece shown and is positioned slightly inboard from the edge of the sheet which is in contact with the seal 26. The framework 41 including the peripheral member 42 are made of strong rigid tubular aluminum and the framework is initially formed to approximate the convex back surface of the sheet 36. In one example of a reflector assembled in accordance with the invention for an antenna of approximately 10 foot aperture an aluminum tubular frame 41, 42 of $3\frac{1}{2}$ inch O.D.$\times$0.083 inch wall thickness and sheet 36 aluminum 0.050 inch thick were satisfactory.

With the framework 41 in place, the individual members including peripheral member 42 are either in contact or in close proximity to the back surface of the sheet 36. A catalyzed epoxy adhesive 51 applied beneath the framework members 41 and 42 is used to provide a bond to the back surface of the sheet 36 and fill the space therebetween. When the epoxy has hardened, the framework 41 and the peripheral member 42 provide structural support for the sheet 36 after vacuum pressure is released such that it maintains the contour that it had assumed due to vacuum pressure against the top caps 33.

Prior to release of the vacuum pressure it is desirable particularly for antenna reflector applications, to provide mounting brackets 52 at three or more points on the peripheral ring 42. These brackets 52 may be attached by epoxy bonding and riveting while the unit is held on the fixture by vacuum pressure. To further provide accurate alignment of the completed unit when in use, the brackets 52 may be precision drilled from a fixture to locate a precision reference mounting hole in each bracket that will permit accurate alignment of the finished reflector within an antenna housing.

Figure 4:
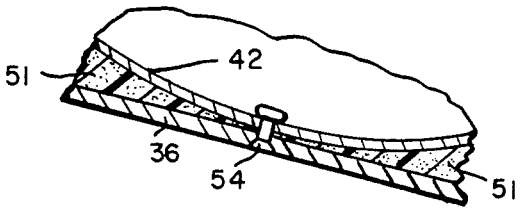
FIG. 4 is a sectional view showing a rivet attachment of the formed surface to a back supporting tubular member.

Upon release of vacuum pressure, the unit as a whole, comprising the sheet 36 and its back frame members 41 and 42 bonded thereto, can be removed from the work table and the shape of the front surface of the sheet 36 has the desired compound curvature determined by the previous setting of the height of the top caps 33. As shown in FIG. 4, the connection between the sheet 36 and the members 41 and 42 can be strengthened by a blind pop rivet 54 which has a flush countersunk head to maintain the continuity of the surface of sheet 36. If desired, the hole in the rivet 54 can be plugged with conductive material and polished smooth.

The method described for forming the sheet 36 to an accurate compound curvature and manufacturing it to be able to maintain that precision shape can be applied to a wide variety of structures of various shapes and for various uses. The invention has been disclosed in particular with reference to forming a large elliptical-shaped sector of a parabolic reflector surface for a microwave antenna and for this purpose sheet 36 is preferably thin aluminum since that material provides the conductive electrical characteristics needed for a microwave reflector. The manufacturing of the sheet to the desired shape will be facilitated if the sheet 36 is first stretch-formed by well known techniques to the approximate parabolic shape desired. This step is actually the prior art method for forming such sheets which in the present invention amounts to a preform so that the precicion final formation of the present invention does not have to deflect the sheet excessive distances, i.e., yielding the material as required when starting with a flat sheet, and the spring back forces which the framework must resist are less since in the stretch-formed sheet the yield point has been exceeded and the residual stress is minimal.

The invention can be practiced with modifications to provide different shapes and contours and different back-supporting structures as well as other forms of cooling as will be apparent from the present detailed description. Accordingly, the invention is to be considered as limited only by the scope of the appended claims.

I claim:

1. The method of precision forming a large area sheet to produce a surface contour of predetermined compound curvature comprising the steps of:

adjusting the length of an array of incrementally spaced support posts over an area to define the locus of said surface contour;

enclosing said array within a housing having a base supporting said posts and continuous peripheral side walls which are approximately the same height as said posts adjacent said side walls with a continuous top surface sealing contact thereon;

locating said sheet on the tops of said posts with its periphery engaging said sealing contact to make an airtight enclosure;

applying vacuum pressure within said housing to draw said sheet into intimate contact with the tops of said posts over said area and engagement with said sealing means;

locating on the exposed back surface of said sheet a framework which after assembly and bonding to said sheet provides sufficient rigidity to maintain contour;

adhering said exposed surface to said framework at the positions of proximate contact with a bonding material that fills the spaces therebetween and rigidly connects said sheet to said framework; and releasing said vacuum to remove said sheet and framework as a unit with said surface contour on said sheet maintained by the rigidity of said framework bonded to said back surface.

2. The method according to claim 1 wherein said sheet is thin metal and including the step of initially stretch-forming said metal sheet to approximate said surface contour.

3. The method according to claim 2 wherein said surface contour is a portion of paraboloid.

4. The method according to claim 3 wherein said framework is comprised of metal tubular members including an approximately elliptical tubular ring near the edge of said paraboloid.

5. The method according to claim 4 and including the step of attacking mounting brackets to said tubular ring before the step of releasing said vacuum.

6. The method of claim 5 and including the step of drilling a mounting hole in each of said brackets using a precision fixture to locate the position of said hole before the step of releasing said vacuum.

7. The method of claim 4 wherein said framework of metal tubular members is rigid and is initially formed to approximate the shape of said exposed back surface.

* * * * *